US005307785A

United States Patent [19]

Yoshikawa

[11] Patent Number: 5,307,785

[45] Date of Patent: May 3, 1994

[54] IGNITION SYSTEM FOR MULTI-VALVE ENGINE

[75] Inventor: Masaaki Yoshikawa, Iwata, Japan

[73] Assignee: Yamaha Hatsudoki Kabushiki Kaisha, Iwata, Japan

[21] Appl. No.: 642,015

[22] Filed: Jan. 16, 1991

[30] Foreign Application Priority Data

Jan. 17, 1990 [JP] Japan ..... 2-6331

[51] Int. Cl.[5] ..... E02P 11/00

[52] U.S. Cl. ..... 123/635; 123/647

[58] Field of Search ..... 123/635, 647, 634

[56] References Cited

U.S. PATENT DOCUMENTS 4,777,925 10/1988 LaSota ..... 123/635
4,903,674 2/1990 Bassett et al. ..... 123/634
4,986,249 1/1991 Nakamura ..... 123/635
4,989,575 2/1991 Kanno ..... 123/635
5,003,958 4/1991 Yoneyama et al. ..... 123/635

*Primary Examiner*—Raymond A. Nelli
*Attorney, Agent, or Firm*—Ernest A. Beutler

[57] ABSTRACT

An ignition system for a multi-valve internal combustion engine wherein the valves all reciprocate about acute angles to a plane containing the cylinder bore axis and wherein a spark plug is positioned in a generally parallel extending direction to the plane and is offset slightly toward the side of the plane containing the most valves. A spark coil is affixed to the terminal end of the spark plug and is itself offset to the other side of the plane to nest between the two poppet valves and provide a compact, low volume combustion chamber and a compact, low height engine arrangement.

18 Claims, 2 Drawing Sheets

IGNITION SYSTEM FOR MULTI-VALVE ENGINE

BACKGROUND OF THE INVENTION

This invention relates to an ignition system for a multi-valve engine and more particularly to an improved compact ignition system.

To improve the performance of an ignition system for an engine, it has been proposed to provide individual spark coils each mounted to the tip of a respective spark plug for firing the spark plug. Such ignition systems provide higher ignition power and better performance. However, in conjunction with such ignition systems there arise certain problems in connection with the spacial disposition of all of the components of the engine.

This problem is particularly acute in conjunction with engine having multiple valves mounted in an overhead fashion. Although it is easy to avoid interference with the valves by placing the spark coils higher in the cylinder head, this adversely affects the overall height of the engine. Therefore, it is desirable to provide a low mounting for the ignition coil. However, this gives rise to certain difficulties, particularly when the valve actuating mechanism for a multiple valve engine is considered.

Although it is possible to lower the ignition coil by canting the axes of reciprocation of the valves in an outboard fashion, this has adverse effects. That is, as the angle of reciprocation of the valves is increased, the heads of the valves define a more steeply inclined combustion chamber and one which has a large surface area and large combustion chamber volume. Both results are to be avoided. Large surface areas provide large quench areas that can reduce the performance of the engine. Large combustion chamber volumes also dictate a low compression ratio which itself deteriorates from the engine performance.

It is, therefore, a principal object to this invention to provide an improved ignition system for a multi-valve engine which permits the use of a spark coil mounted on the spark plug and yet permits a compact engine configuration.

It is a further object to this invention to provide an improved ignition system for an engine having a spark plug mounted spark coil wherein a compact engine can be provided, multi-valves employed and a high compression ratio and compact combustion chamber surface will result.

SUMMARY OF THE INVENTION

This invention is adapted to be embodied in an ignition system for a multi-valve engine comprised of a cylinder head forming a combustion chamber. A plurality of poppet valves are supported for reciprocation within the cylinder head and serve the combustion chamber. A spark plug is supported within the cylinder head with its spark gap positioned substantially on the center of the combustion chamber and a spark coil is mounted to the terminal end of the spark plug for firing the spark plug. In accordance with the invention, the spark coil is offset to one side of the spark plug and in an area between at least two of the valves.

DETAILED DESCRIPTION OF THE PREFERRED EMBODIMENT OF THE INVENTION

Figure 1:
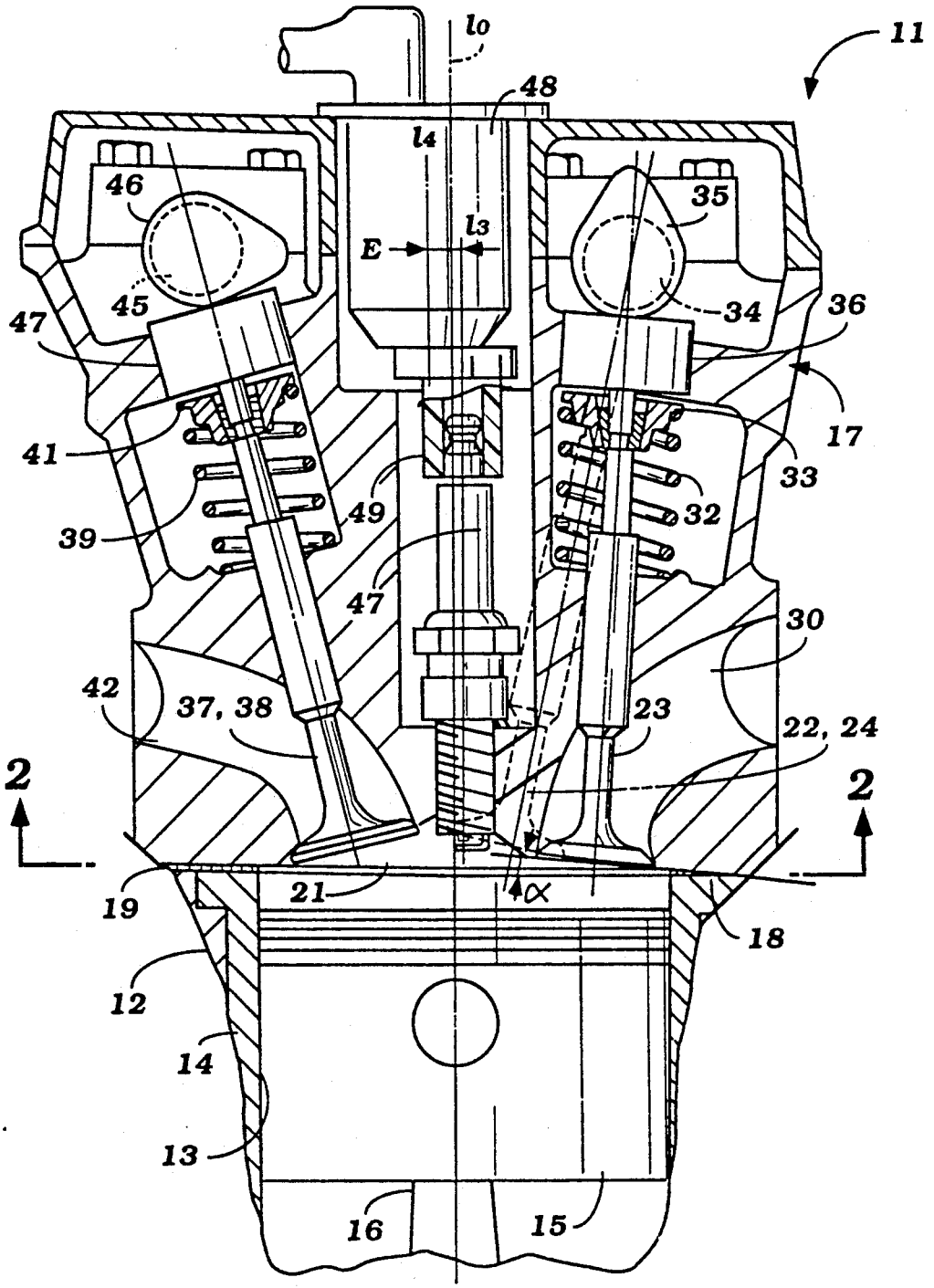
FIG. 1 is a cross sectional view taken through a single cylinder of an internal combustion engine along a generally vertically extending plane and showing the engine partially.

Referring in detail to the drawings, an internal combustion engine having an ignition system constructed in accordance with an embodiment of the invention is identified generally by the reference numeral 11. The engine 11 is shown only partially and only a portion of a single cylinder of the engine 11 is depicted. It should be readily apparent to those skilled in the art how the invention can be employed with multiple cylinder engines and engines having various cylinder configurations such an incline, V-type, opposed, cetera. The engine Il includes a cylinder block 12 having a cylinder bore 13 formed by a pressed in liner 14. A piston 15 reciprocates in the cylinder bore 13 and is connected by means of a connecting rod 16 to a crankshaft (not shown) for driving the crankshaft in a known manner.

Figure 2:
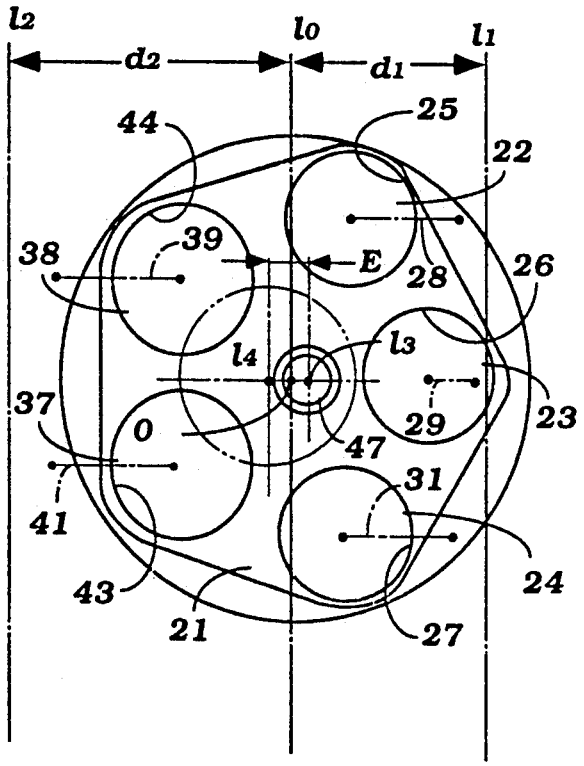
FIG. 2 is a view showing the configuration of the combustion chamber and the valve placement looking generally in the direction of the line 2—2 in FIG. 1.

A cylinder head assembly, indicated generally by the reference numeral 17, is affixed to the cylinder block 12 in a suitable manner. The cylinder head assembly 17 has a lower face 18 which is sealingly engaged with a cylinder head gasket 19 that encircles the cylinder bore 13. In addition, a central recess 21 having a pent roof configuration surrounded by a squish are as shown in FIG. 2 is formed in the lower surface of the cylinder head 17 and surrounded by the sealing surface 18. This recess forms in part the combustion chamber of the engine and the recess 21 will at times be hereinafter referred to as the combustion chamber, it being understood that the entire combustion chamber is formed only partially by the recess 21.

In a preferred embodiment of the invention, the cylinder head 17 includes an induction system which is comprised of three intake valves 22, 23 and 24 which are mounted generally to one side of a plane $l_0$ that contains the cylinder bore axis 0. The intake valves 22 and 24 are side intake valves and portions of their heads lie slightly on the other side of the plane $l_0$ when the intake valves are all in their closed positions as shown in FIG. 2. The intake valves 22, 23 and 24 cooperate with respective valve seats 25, 26 and 27 formed in the cylinder head 17 in appropriate manner and which form the terminus of an intake passage 30 that extends through the intake side of the cylinder head 17 and terminates at the valve seats 25, 26 and 27, respectively. The described construction is that of a siamese configuration but it is to be understood that the invention may be equally as well practiced in conjunction with engines having individual intake passages for each of the valves seats 25, 26 and 27.

The intake valves 22, 23 and 24 have respective valve stems 28, 29 and 31 each of which is disposed at an acute angle to the plane $l_0$. The axes of the valve stems 28 and 31 are generally parallel to each other and are inclined at the same acute angle to the plane $l_0$. The acute angle of the intake valve stem 29 is different from these acute angles although the plane defined by the stem 29 is parallel to that of the stems 28 and 31 and this acute angle is less than the acute angle of the stems 28 and 31. Although the stems 28, 29 and 31 are described as reciprocating in parallel planes, they may be slightly skewed if desired.

Coil compression springs 32 encircle each of the valve stems and are held in place by keeper retainer assemblies 33 for urging the intake valves 22, 23 and 24 to their closed positions.

The axes of reciprocation of the valve stems 28, 29 and 31 all intersect a line which is coincident to the axis of rotation of an intake cam shaft 34 which is journaled in the cylinder head 17 in appropriate manner and which has cam lobes 35 which cooperate with individual thimble tappets 36 for opening the intakes valves 22, 23 and 24, respectively.

The configuration of the intake valves 22, 23 and 24 and their specific disposition is generally of the type described in U.S. Pat. No. 4,660,529, entitled "Four Cycle Engine", issued Apr. 28, 1987 in the name of Masaaki Yoshikawa and assigned to the Assignee hereof. Specifically, the construction is of the general type shown in the embodiment of FIGS. 1 through 4 of that patent. As described therein, the valve orientation described permits a compact cylinder configuration that provides a high compression ratio and low surface are and volume, as afore described.

A pair of exhaust valves 37 and 38 are disposed so that their head portions lie on the other side of the plane $l_0$ and have their respective stems 39 and 41 reciprocating about parallel planes that lie in a common longitudinal plane at the same acute angle to the plane $l_0$. This acute angle is less than the acute angle of reciprocation of the valves 22 and 24 and greater than the acute angle of reciprocation of the intake valve 23. Coil compression springs 39 engage keeper retainer assemblies 41 for urging the exhaust valves 37 and 38 to their closed positions. Exhaust passages 42 extend through the cylinder head 17 and terminate at respective valve seats 43 and 44 which are controlled by the heads of the exhaust valves 37 and 38. An exhaust cam shaft 45 is rotatably journaled in the cylinder head 17 and has lobe portions 46 that engage thimble tappets 47 for opening and closing the exhaust valves 37 and 38.

It should be noted that the axis of rotation $l_1$ of the intake camshaft 34 is disposed at a lesser distance $d_1$ than the distance $d_2$ between the plane $l_0$ and the axis of rotation $l_2$ of the exhaust camshaft 45. This offsetting provides clearance for the ignition system, to be hereinafter described. It should be noted that the tips of the stems 28, 29 and 31 of the intake valves 22, 23 and 24 all lie inwardly of an extension of the cylinder bore axis 13 so as to provide a compact assembly and that the intake camshaft axis $l_1$ also lies within the cylinder bore axis as clearly shown in FIG. 2. This provides a compact assembly and the afore described compact combustion chamber configuration.

In accordance with a feature of the invention, a spark plug 47 is mounted in the cylinder head assembly 17 with its longitudinal center line $l_3$ extending substantially parallel to the cylinder bore axis $l_0$ at a slight offset as clearly shown in FIGS. 1 and 2 toward the intake camshaft 34. The gap of the spark plug 47 is, therefore, offset only slightly from the cylinder bore axis $l_0$ so as to provide substantailly equal flame travel within the combustion chamber. A spark coil 48 is mounted by means of a terminal 49 on the terminal end of the spark plug 48. The spark coil 48 is generally cylindrical in configuration and has its longitudinal axis $l_4$ offset a distance E from the axis $l_3$ of the spark plug toward the exhaust side. As a result, the spark coil 48 will be nested between the exhaust valves 37 and 38 and provide a very compact configuration without increasing the height of the engine. In addition, this eccentric location of the coil 48 relative to the spark plug 47 insures that the coil 48 will not be rotated relative to the spark plug 47 upon installation.

In the afore described construction, the invention has been employed with an engine having both intake and exhaust overhead camshafts for operating the valves. Of course, the engine can be employed with other types of camshaft configurations including those having only a single camshaft for operating all of the valves through individual rocker arms. Various other changes and modifications may be made without departing from the spirit and scope of the invention, as defined by the appended claims.

I claim:

1. An ignition system for a multi-valve engine comprised of a cylinder head forming a combustion chamber, a plurality of poppet valves supported for reciprocation within said cylinder head, said valves being positioned at not greater than acute angles to a plane containing the axis of an associated cylinder bore with more of the poppet valves lying on one side of said plane than on the other side of the plane, a spark plug supported within said cylinder head with a spark plug gap position substantially on the center of said combustion chamber, and a spark coil mounted to the terminal end of said spark plug for firing said spark plug, said spark coil having a longitudinal axis which longitudinal axis is offset to one side of said spark plug and in an area between at least two of said valves.

2. An ignition system as set forth in claim 1 wherein the spark plug is offset to the side of the plane where the lesser number of the poppet valves are positioned.

3. An ignition system as set forth in claim 2 wherein the spark plug is positioned with its gap offset to the plane on the side toward the greater number of valves.

4. An ignition system as set forth in claim 1 further including a pair of camshafts supported for rotation on opposite sides of the plane about axes extending parallel to the plane for operating the respective of the poppet valves.

5. An ignition system as set forth in claim 4 wherein one of the camshafts is positioned closer to the plane than the other of the camshafts.

6. An ignition system as set forth in claim 5 wherein the spark coil is offset to the side of the plane on the same side as the camshaft that is furthest from the plane.

7. An ignition system as set forth in claim 6 wherein the spark coil is offset to the side of the plane where the lesser number of the poppet valves are positioned.

8. An ignition system as set forth in claim 7 wherein the spark plug is positioned with its gap offset to the plane on the side toward the greater number of valves.

9. An ignition system as set forth in claim 8 wherein there are three poppet valves on the one side of the plane and two poppet valves on the other side of the plane.

10. An ignition system as set forth in claim 1 wherein there are three poppet valves having their head portions lying substantially on the one side of the plane and two poppet valves on the other side of said plane, two of said three poppet valves reciprocating about respective parallel axes that lie in a common plane at a first acute angle to the plane, the third of said three poppet valves reciprocating about an axis that lies at a lesser acute angle to the plane than the first acute angle, the two poppet valves on the other side of said plane reciprocating about parallel axes that lie at the same acute angle to the plane which acute angle is less than said first acute angle and greater than the acute angle of the third poppet valve.

11. An ignition system as set forth in claim 10 wherein the spark plug lies parallel to the plane containing the axis of an associated cylinder bore.

12. An ignition system as set forth in claim 10 wherein the spark coil is offset to the other side of the plane.

13. An ignition system as set forth in claim 12 wherein the spark plug is positioned with its gap offset to the one side of the plane.

14. An ignition system as set forth in claim 10 further including a pair of camshafts supported for rotation on opposite sides of the plane about axes extending parallel to the plane for operating the respective of the poppet valves.

15. An ignition system as set forth in claim 14 wherein one of the camshafts is positioned closer to the plane than the other of the camshafts.

16. An ignition system as set forth in claim 15 wherein the spark coil is offset to the side of the plane on the same side as the camshaft that is furthest from the plane.

17. An ignition system as set forth in claim 16 wherein the spark coil is offset to the other side of the plane.

18. An ignition system as set forth in claim 17 wherein the spark plug is positioned with its gap offset to the one side of the plane.

* * * * *